US009139334B2

(12) United States Patent
Wahl

(10) Patent No.: US 9,139,334 B2
(45) Date of Patent: Sep. 22, 2015

(54) PALLET AND METHOD FOR USING THE PALLET

(71) Applicant: Torben Wahl, St Kilda (AU)

(72) Inventor: Torben Wahl, St Kilda (AU)

( * ) Notice: Subject to any disclaimer, the term of this patent is extended or adjusted under 35 U.S.C. 154(b) by 0 days.

(21) Appl. No.: 14/346,791

(22) PCT Filed: Sep. 21, 2012

(86) PCT No.: PCT/AU2012/001142

§ 371 (c)(1),
(2) Date: Mar. 24, 2014

(87) PCT Pub. No.: WO2013/040651

PCT Pub. Date: Mar. 28, 2013

(65) Prior Publication Data

US 2014/0283714 A1 Sep. 25, 2014

(30) Foreign Application Priority Data

Sep. 23, 2011 (AU) ..... 2011903933

(51) Int. Cl.
*B65D 19/00* (2006.01)
*B65D 19/38* (2006.01)

(52) U.S. Cl.
CPC ..... *B65D 19/38* (2013.01); *B65D 19/0014* (2013.01); *B65D 19/0016* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/0099* (2013.01); *B65D 2519/00129* (2013.01); *B65D 2519/00139* (2013.01); *B65D 2519/00273* (2013.01); *B65D 2519/00288* (2013.01); *B65D 2519/00318* (2013.01);

(Continued)

(58) Field of Classification Search
CPC ..... B65D 2519/00323; B65D 2519/00398; B65D 2519/00412; B65D 2519/00417
USPC ..... 108/51.11, 51.3, 57.25, 901, 902
See application file for complete search history.

(56) References Cited

U.S. PATENT DOCUMENTS 2,311,280 A * 2/1943 Quayle ..... 108/57.1
2,651,486 A * 9/1953 Woodward ..... 108/57.1

(Continued)

FOREIGN PATENT DOCUMENTS

| | | |
|---|---|---|
| DE | 10 2008 014 020 | 10/2009 |
| JP | 2010/241444 | 10/2010 |
| KR | 2009-0030377 | 3/2009 |

OTHER PUBLICATIONS

International Search Report for PCT/AU2012/001142 mailed Dec. 13, 2012.

*Primary Examiner* — Jose V Chen
(74) *Attorney, Agent, or Firm* — Nixon & Vanderhye P.C.

(57) ABSTRACT

A pallet for transporting and/or storing goods, wherein the pallet includes a body and protective elements removably coupled to the body to prevent damage to the body. In one form, the protective elements are coupled to the body by releasable coupling means to facilitate removal of the protective elements and replacement of the protective elements with other, like, protective elements. The body may have openings for receiving a fork of a lifting device to allow lifting of the pallet by the lifting device, and the protective elements may be located at specific locations of the body to abut the lifting device during insertion of the fork in the openings and/or lifting of the pallet by the lifting device.

21 Claims, 17 Drawing Sheets

(52) U.S. Cl.
CPC ..... *B65D2519/00333* (2013.01); *B65D 2519/00407* (2013.01); *B65D 2519/00412* (2013.01); *B65D 2519/00437* (2013.01); *B65D 2519/00442* (2013.01); *B65D 2519/00562* (2013.01); *B65D 2519/00567* (2013.01); *B65D 2519/00736* (2013.01); *B65D 2519/00791* (2013.01)

(56) References Cited

U.S. PATENT DOCUMENTS

| | | | | | |
|---|---|---|---|---|---|
| 2,823,883 | A | * | 2/1958 | Bourdon | 108/57.1 |
| 3,079,877 | A | * | 3/1963 | Doane | 108/51.3 |
| 3,645,215 | A | * | 2/1972 | Kirkpatrick | 108/57.23 |
| 3,675,596 | A | * | 7/1972 | Colas | 108/51.11 |
| 4,292,899 | A | * | 10/1981 | Steffen | 108/51.11 |
| 4,715,294 | A | * | 12/1987 | Depew | 108/57.17 |
| 4,931,340 | A | * | 6/1990 | Baba et al. | 428/73 |
| 5,320,048 | A | * | 6/1994 | Feiner | 108/51.11 |
| 5,402,735 | A | * | 4/1995 | DeJean | 108/57.17 |
| 5,579,701 | A | * | 12/1996 | Wah | 108/56.1 |
| 5,673,629 | A | * | 10/1997 | Ginnow | 108/57.17 |
| 5,809,902 | A | * | 9/1998 | Zetterberg | 108/51.11 |
| 5,868,080 | A | * | 2/1999 | Wyler et al. | 108/57.25 |
| 6,216,608 | B1 | * | 4/2001 | Woods et al. | 108/57.25 |
| 6,260,487 | B1 | * | 7/2001 | Giorgio | 108/51.11 |
| 6,374,753 | B1 | * | 4/2002 | Radke, Jr. | 108/51.11 |
| 6,766,749 | B2 | * | 7/2004 | Lacabanne | 108/56.3 |
| 8,261,673 | B2 | * | 9/2012 | Ingham | 108/51.11 |
| 8,424,468 | B2 | * | 4/2013 | Aden et al. | 108/56.3 |
| 8,671,848 | B2 | * | 3/2014 | Randall et al. | 108/51.11 |
| 2005/0017000 | A1 | | 1/2005 | Vergiels et al. | |
| 2009/0255446 | A1 | * | 10/2009 | Kirkpatrick | 108/57.33 |
| 2010/0229764 | A1 | * | 9/2010 | Ingham | 108/51.3 |
| 2013/0061784 | A1 | * | 3/2013 | Kessler | 108/57.25 |
| 2014/0251190 | A1 | * | 9/2014 | Kessler | 108/57.25 |

* cited by examiner

PALLET AND METHOD FOR USING THE PALLET

This application is the U.S. national phase of International Application No. PCT/AU2012/001142 filed 21 Sep. 2012 which designated the U.S. and claims priority to AU 2011903933 filed 23 Sep. 2011, the entire contents of each of which are hereby incorporated by reference.

TECHNICAL FIELD

The invention relates to a pallet for transporting and/or storing palletized goods. More particularly, but not exclusively, the invention relates to a general purpose pallet which is configured to reduce the overall cost of employing a pallet system.

BACKGROUND

It is known to use pallets for transporting/storing palletized goods. A pallet is typically made of wood or plastic and is in the form of a flat transport structure that supports goods in a stable fashion while being lifted by a forklift, pallet jack, front loader or other lifting device. A pallet is the structural foundation of a unit load which allows handling and storage efficiencies.

Plastic pallets offer environmental advantages as they are able to be repeatedly used many more times than wooden pallets. Moreover, whereas wooden pallets require refurbishment to replace broken or missing deck boards or nails, no such refurbishment is required in the use of plastic pallets. A further advantage exists in that, at the end of the service life, a plastic pallet is able to be ground and recycled into new pallets.

However, the applicant has determined that it would be beneficial for there to be provided an improved general purpose pallet which has a reduced vulnerability to being rendered unserviceable through damage. He has also identified that the cause of much damage to existing pallets is through the use of forked lifting devices, and that it would be advantageous to reduce and/or eliminate the damage caused in this way.

Examples of the present invention seek to provide an improved pallet which overcomes or at least alleviates one or more disadvantages associated with previous pallets.

BRIEF SUMMARY

In accordance with one aspect of the present invention example embodiments, there is provided a pallet for transporting and/or storing goods, wherein the pallet includes a body and protective elements removably coupled to the body to prevent damage to the body.

Preferably, the protective elements are coupled to the body by releasable coupling means to facilitate removal of the protective elements and replacement of the protective elements with other, like, protective elements. More preferably, the releasable coupling means is provided by resilience in the protective elements and/or the body, whereby the resilience is overcome in both coupling and decoupling the protective elements. Even more preferably, the releasable coupling means is provided by the protective elements being resiliently deformable, and the protective elements are deformed in both coupling and decoupling the protective elements to/from the body.

Preferably, the body has openings for receiving a fork of a lifting device to allow lifting of the pallet by the lifting device, and the protective elements are located at specific locations of the body to abut the lifting device during insertion of the fork in the openings and/or lifting of the pallet by the lifting device. More preferably, the protective elements are located to abut the lifting device when the fork is fully inserted in the openings. Even more preferably, the protective elements are located above each of the openings.

In one example, a separate protective element is associated with each separate opening. The pallet may have two openings along each edge to allow insertion of the fork into any edge of the pallet. The pallet may be generally rectangular and, more particularly, square.

Preferably, the protective elements are located at external corners of the pallet.

In a preferred form, the body is made of high impact composite. More preferably, the body is made of reinforced thermoplastic, and the protective elements are made of high impact thermoplastic. Even more preferably, the body and the protective elements are made of the same thermoplastic, e.g. PET, PP, HDPE or similar.

Preferably, the body is recessed at the locations where the protective elements are coupled to allow for the thickness of the protective elements and to thereby minimize protrusion of the elements beyond the extremities of the body.

Preferably, each of the protective elements has interlocking formations which interlock with corresponding interlocking formations of the body.

In a preferred form, the body is in the form of an assembly including a lower portion and an upper portion. The two parts of the core pallet, top and bottom, are assembled once (i.e. permanently) and most likely not taken apart before end of life and recycling of the pallet. More preferably, the protective elements (impact bumpers) are by mechanical means pressed or pulled in the horizontal plane of the pallet, on or off the vertical sides/corners of the pallet.

In an alternative form, the body is in the form of an assembly including a lower portion and an upper portion, and the protective elements are removed by demounting the upper portion from the lower portion. The protective elements may be engaged to the body by sliding tongues of the upper and lower portions into grooves of the protective elements.

In accordance with another aspect of the present invention example embodiments, there is provided a method of using a pallet as described above, including the steps of:

- fitting the pallet with replaceable elements in the form of bumpers;
- using the pallet to transport and/or store goods;
- checking the condition of the bumpers to determine whether each of the bumpers is ready to be replaced; and
- for each of the bumpers needing to be replaced, removing the bumper and fitting a replacement bumper in its place.

Preferably, the process is automated.

BRIEF DESCRIPTION OF THE DRAWINGS

The invention is described, by way of non-limiting example only, with reference to the accompanying drawings, in which.

DETAILED DESCRIPTION

With reference to FIGS. 1 to 5 of the drawings, there is shown a pallet 10 for transporting and/or storing goods. The pallet 10 includes a body 12 and protective elements 14 removably coupled to the body 12 to prevent damage to the body 12. The protective elements 14 are in the form of replaceable bumpers 16 which are located at parts of the pallet 10 which have been identified by the applicant as being particularly vulnerable to damage. Advantageously, the replacable bumpers 16 act sacrificially such that they are damaged in preference to the body 12 being damaged and, as they are relatively small and inexpensive, the replaceable bumpers 16 are able to be replaced cost-effectively when damaged to restore the condition of the pallet 10. Accordingly, the replaceable bumpers 16 are able to be removed and replaced quickly and economically, reducing labour and overall cost of using a pallet system, increasing the lifespan of each pallet.

The pallet 10 may be in the form of a single or double-deck transport pallet which facilitates a fully automatic process of maintenance. The maintenance may be done by electronic scanning with any damaged impact bumpers being replaced in a fully automated repair setup. The repair setup can be a permanent part of a pallet depot, or may work as an independent mobile maintenance unit in any convenient location. Pallets which are damaged beyond repair may be returned to the pallet provider and recycled into new pallets.

With more specific reference to the drawings, the protective elements 14 are coupled to the body 12 by releasable coupling means to facilitate removal of the protective elements 14, and replacement of the protective elements 14 with other, like, protective elements. The releasable coupling means may be provided by resilience in the protective elements 14 and/or the body 12, whereby the resilience is overcome in both coupling and decoupling the protective elements 14. The protective elements 14 may be resiliently deformable, and may be deformed in both coupling and decoupling the protective elements 14 to/from the body 12. In this way, the protective elements 14 may be coupled to the body 12 in a "snap lock" fitting arrangement.

Figure 1:
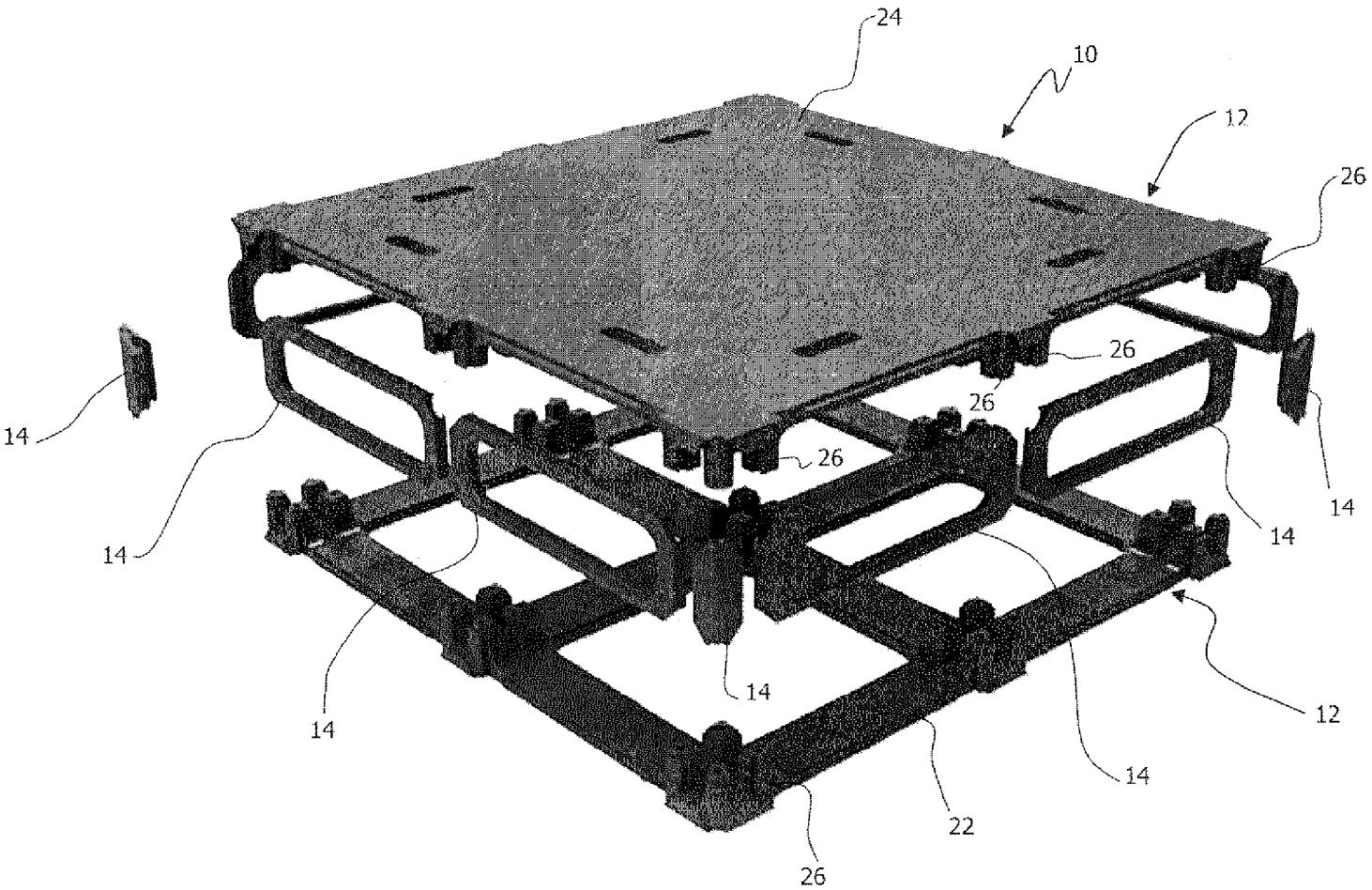
FIG. 1 is an exploded perspective view of a pallet in accordance with an example of the present invention.

Alternatively, the releasable coupling means may be provided by way of the protective elements 14 and body 12 being configured to interlock, instead of (or as well as) there being any resilience in the material of the protective elements 14/body 12. More particularly, each of the protective elements 14 may have interlocking formations 18 (see detail in FIGS. 4 and 5) which interlock with corresponding interlocking formations 20 of the body 12. As shown in FIG. 1, the body 12 is in the form of an assembly including a lower portion 22 and an upper portion 24, wherein the protective elements 14 are removed by pulling them off in a direction generally parallel to the plane of the pallet comprising the assembly of portions 24 and 22. In particular, the protective elements 14 are engaged to the body 12 by inward mechanical pressure in the direction generally parallel to the plane of the pallet whereby a snap-fit interlocking connection occurs between the protective elements 14 and the pallet core body 12. Although this interlocking arrangement may be used in combination with the protective elements 14 and/or the body 12 being resilient, it may be preferred that the interlocking arrangement is utilised with little or no resilience in the material to avoid inadvertent release of the protective elements 14 from the body 12.

The body 12 has openings 30 for receiving a fork of a lifting device to allow lifting of the pallet 10 by the lifting device. The lifting device may be in the form of a forklift, pallet jack or other type of lifting device. The protective elements 14 are located at specific locations of the body 12 to abut the lifting device during insertion of the fork in the openings 30, and/or during lifting of the pallet 10 by the lifting device. The protective elements 14 may be located above each of the openings 30 so as to abut the lifting device when the fork is fully inserted in the openings 30. In the example shown in the drawings, each of the side edge protective elements 14 is in the form of an elongated ring which has a central aperture 32 for feeding a prong of the fork therethrough. A separate side edge protective element 14 is associated with each separate opening 30. The pallet 10 may have two openings 30 along each edge to allow insertion of the fork into any edge of the pallet 10. The pallet 10 may be generally rectangular and, more particularly, square.

Figure 5:
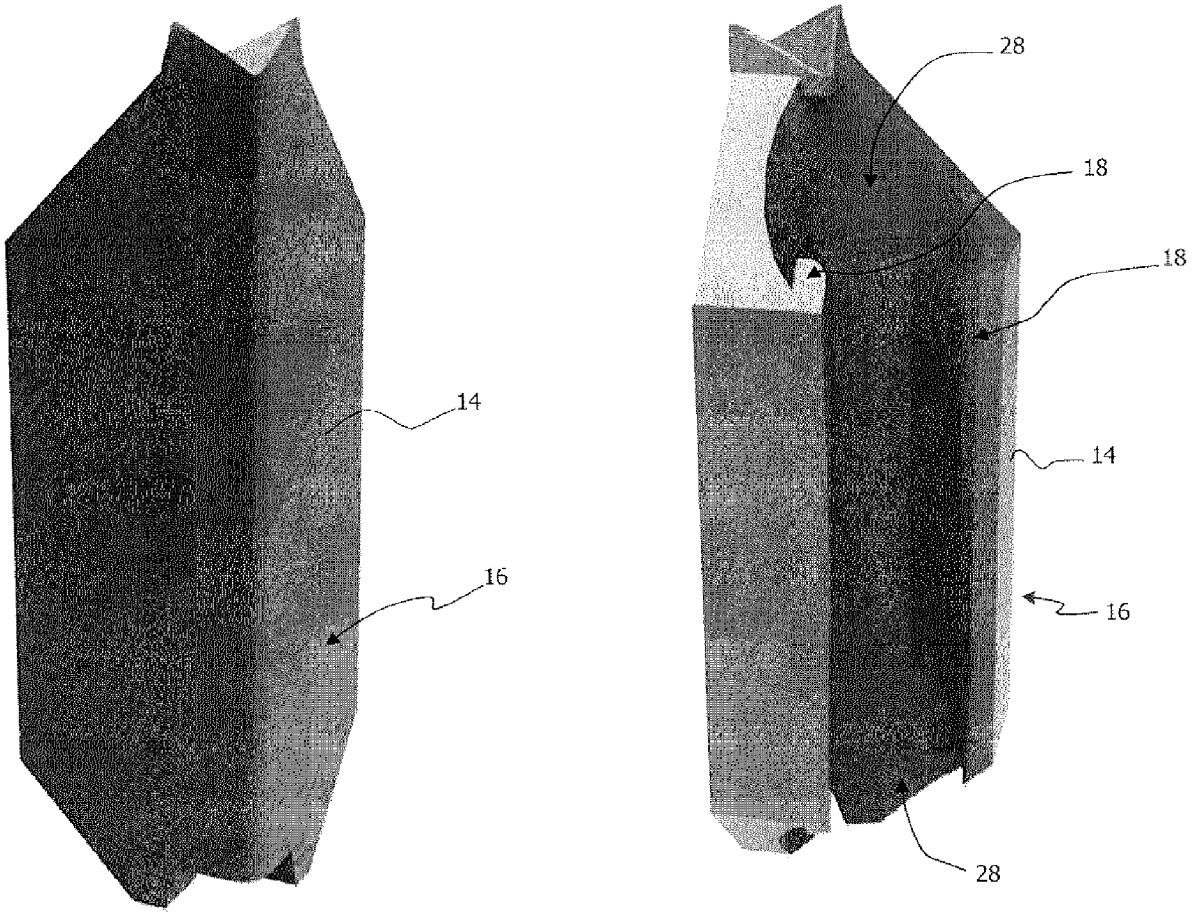
FIG. 5 shows front and rear perspective views of a corner protective element of the pallet.
Figure 6:
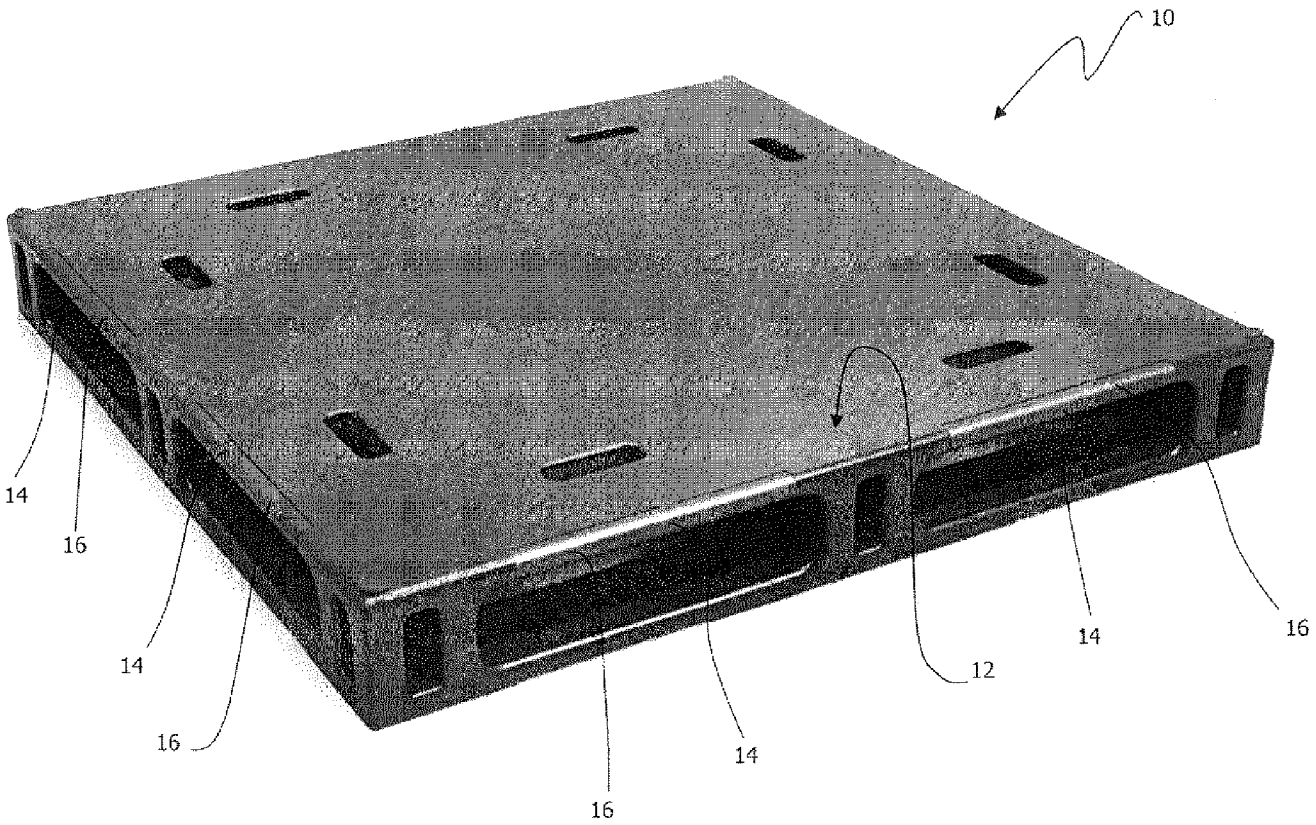
FIG. 6 shows a top perspective view of a pallet in accordance with another example of the present invention.
Figure 7:
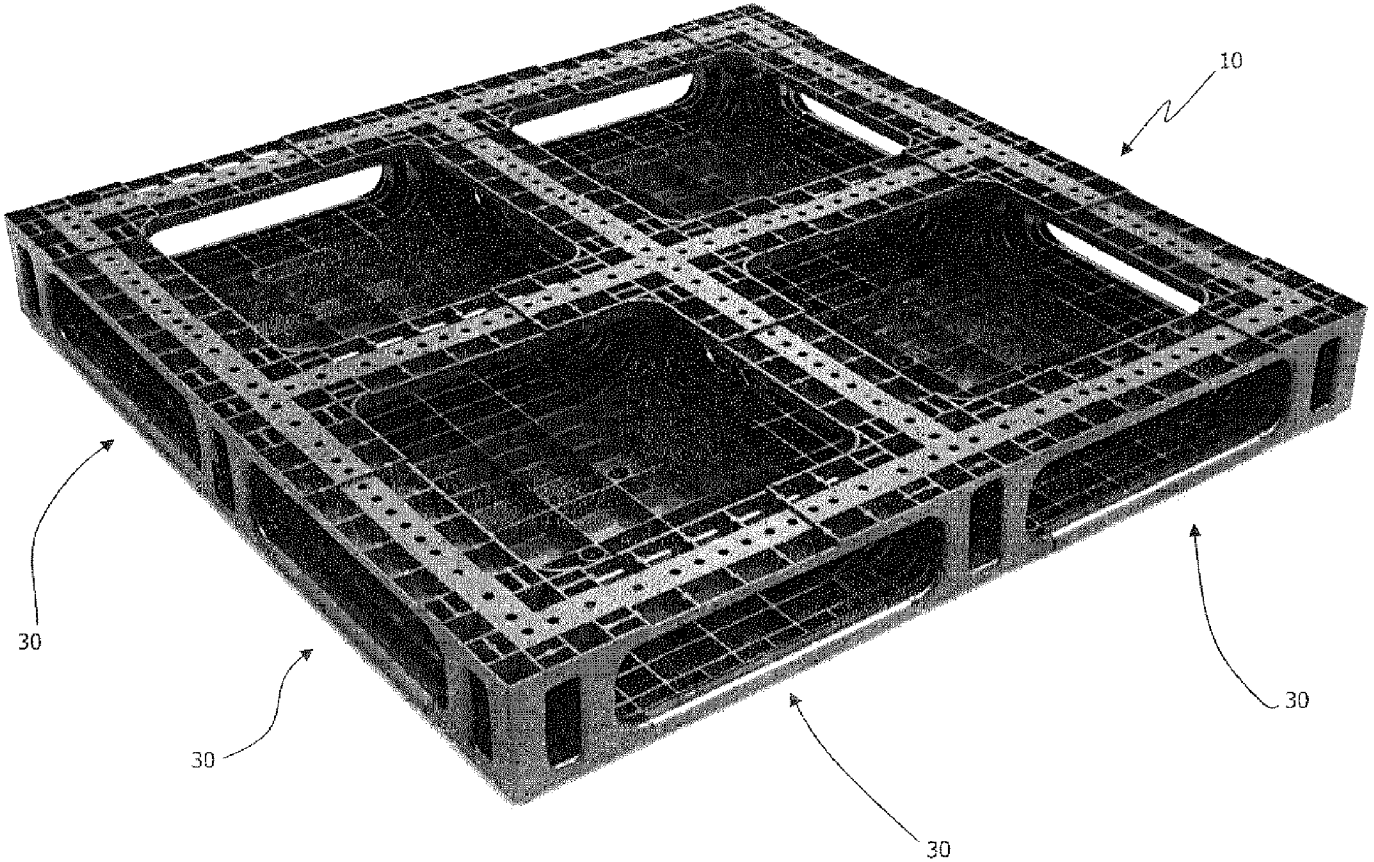
FIG. 7 shows a bottom perspective view of the pallet.
Figure 8:
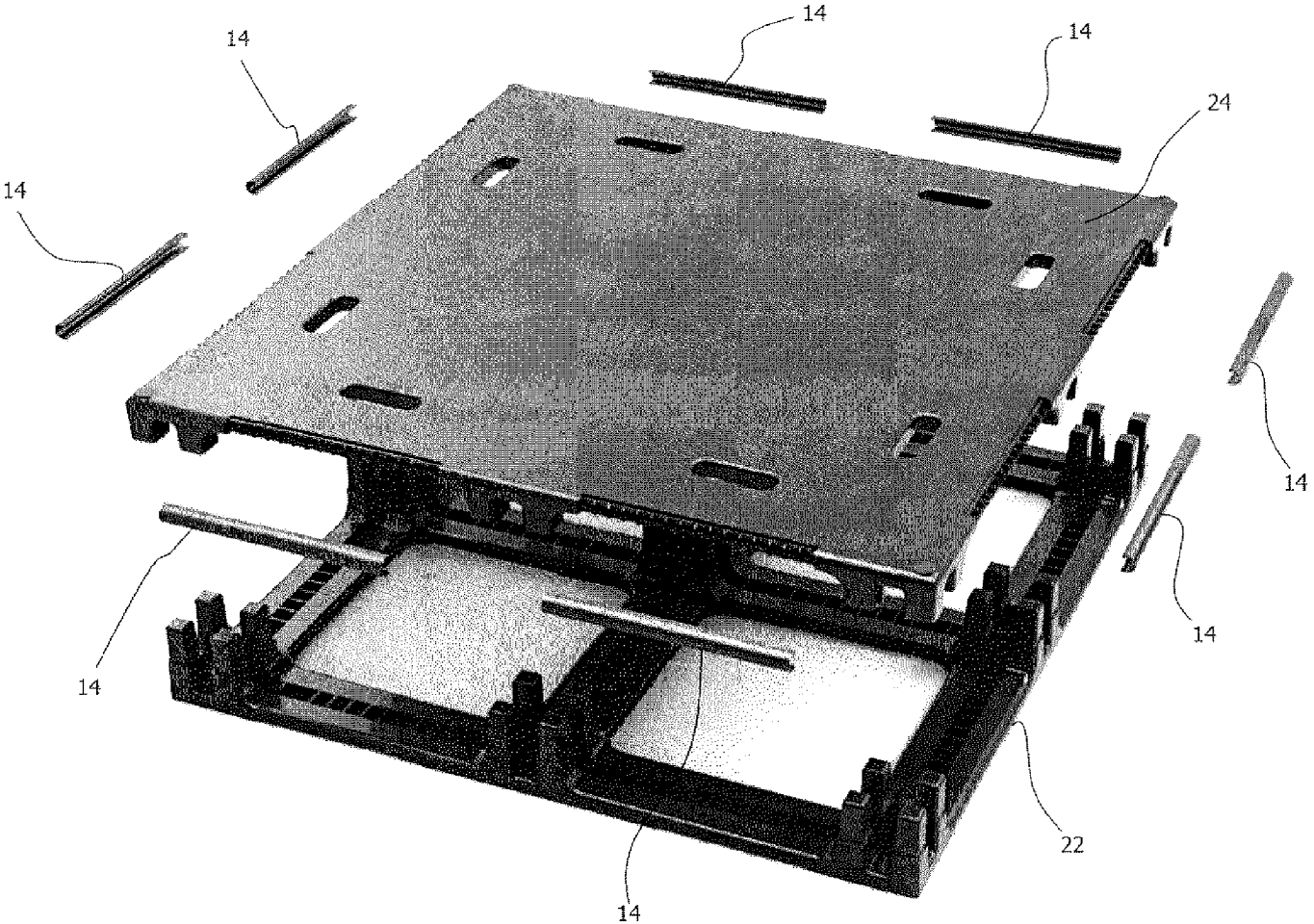
FIG. 8 is an exploded perspective view of the pallet.
Figure 9:
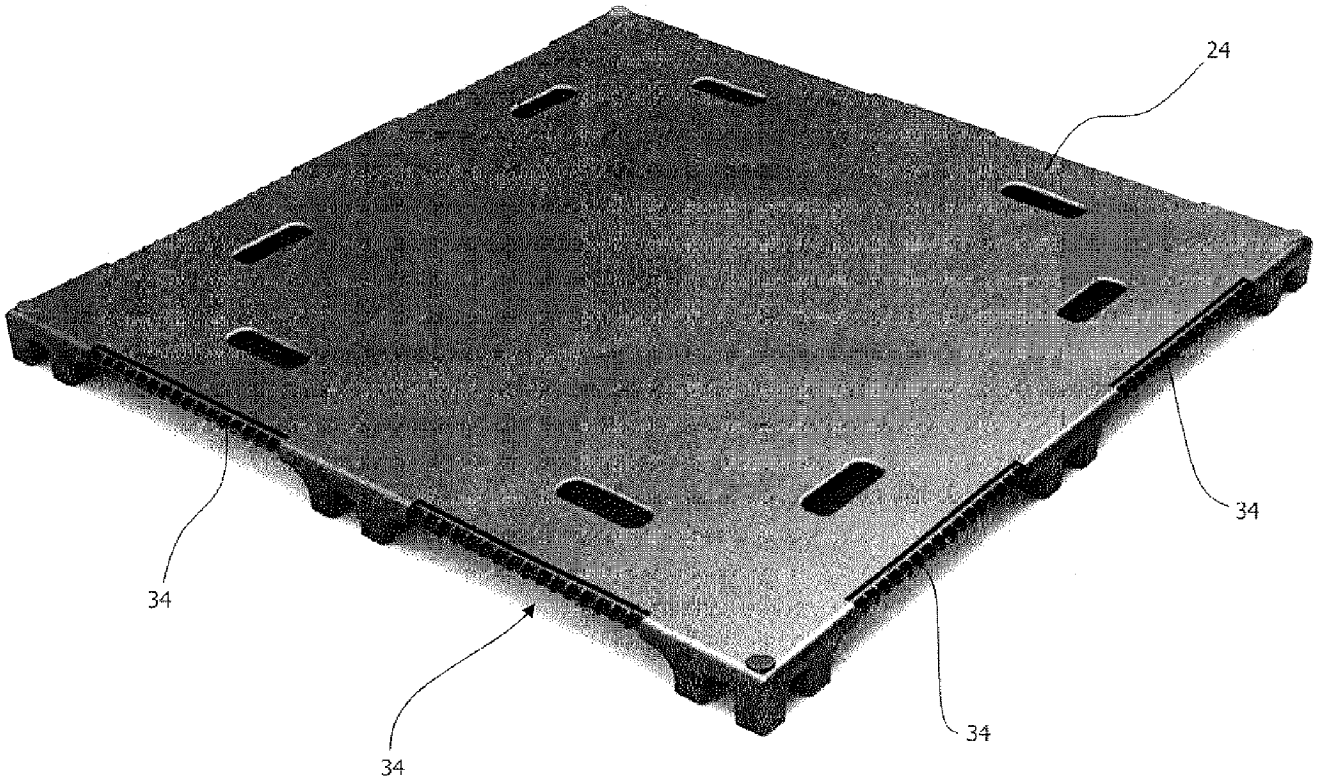
FIG. 9 shows a top perspective view of an upper portion of the pallet.

The pallet may also be provided with protective elements 14 located at external corners of the pallet 10. Detail of the corner protective elements 14 are shown in FIG. 5. As can be seen, the corner protective elements 14 have interlocking formations 18, in a manner generally similar to that of the side edge protective elements 14.

The body 12 may be made of wood, metal or high impact composite and, more specifically, reinforced thermoplastic. The protective elements 14 may be made of non-reinforced thermoplastic, the thermoplastic of the body 12 and the protective elements 14 being of the same type. The specific type of plastic used may be PET, PP, HDPE or a different plastic.

Figure 2:
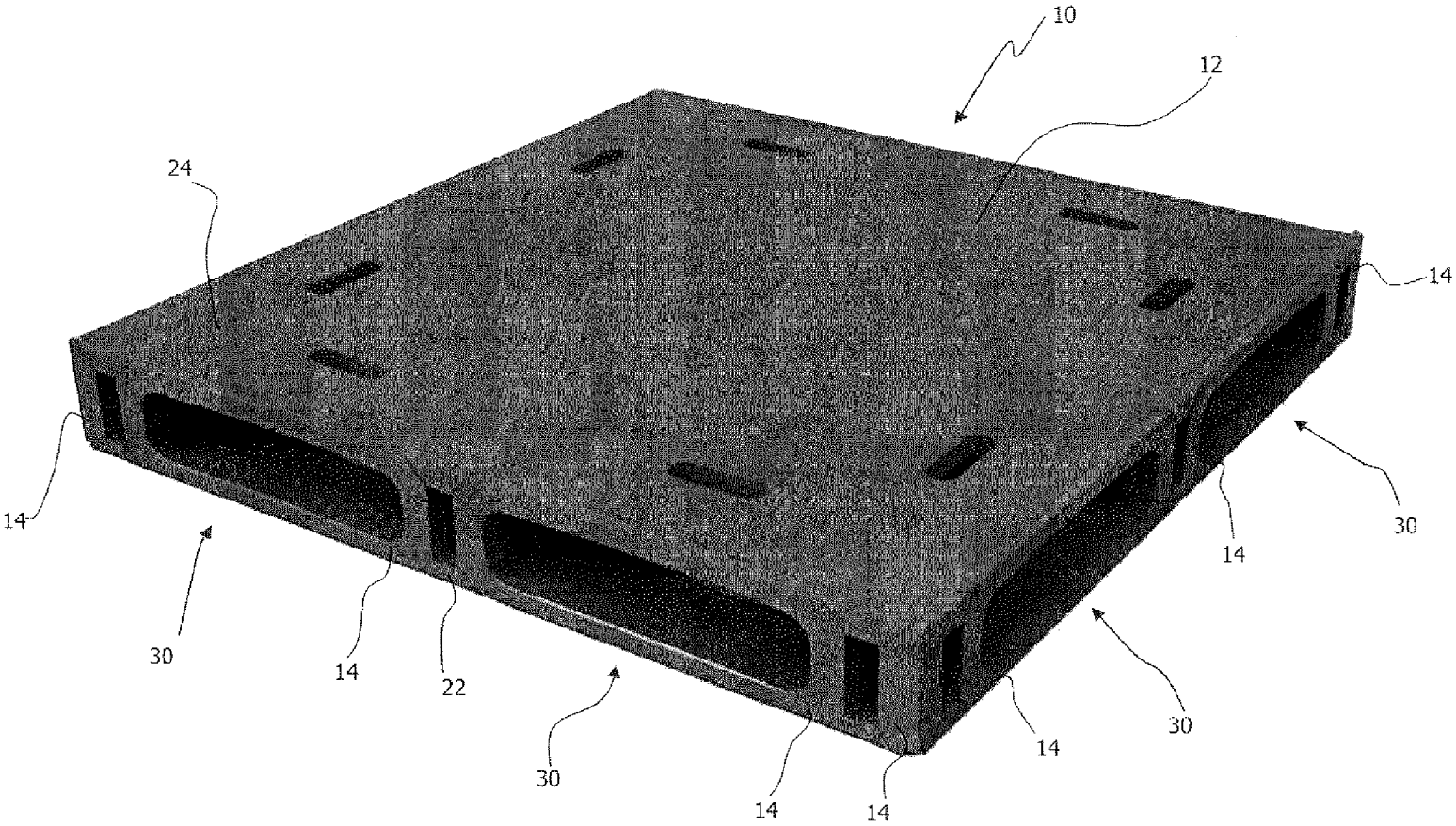
FIG. 2 is a top perspective view of the pallet, shown assembled.
Figure 3:
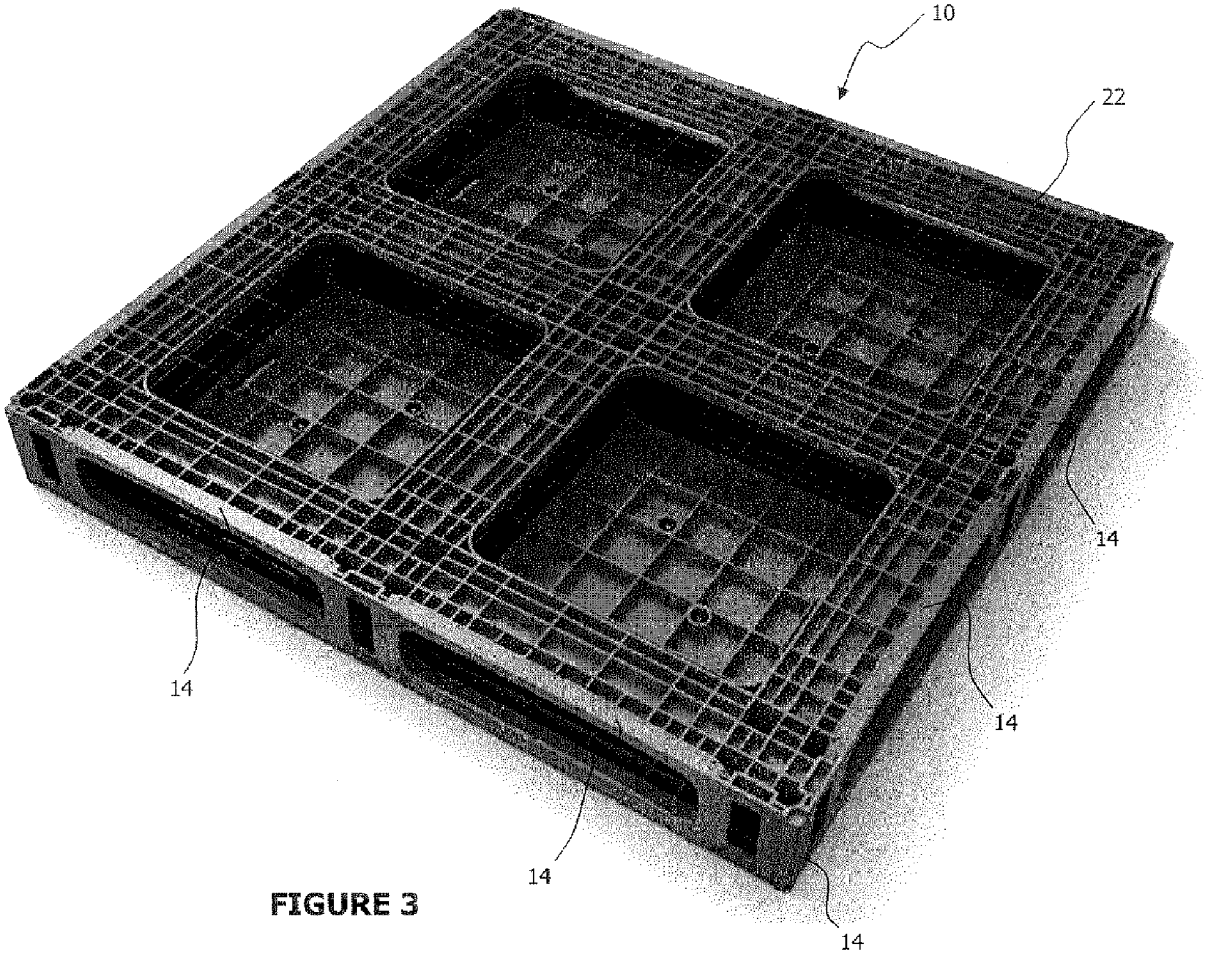
FIG. 3 is a bottom perspective view of the pallet.
Figure 4:
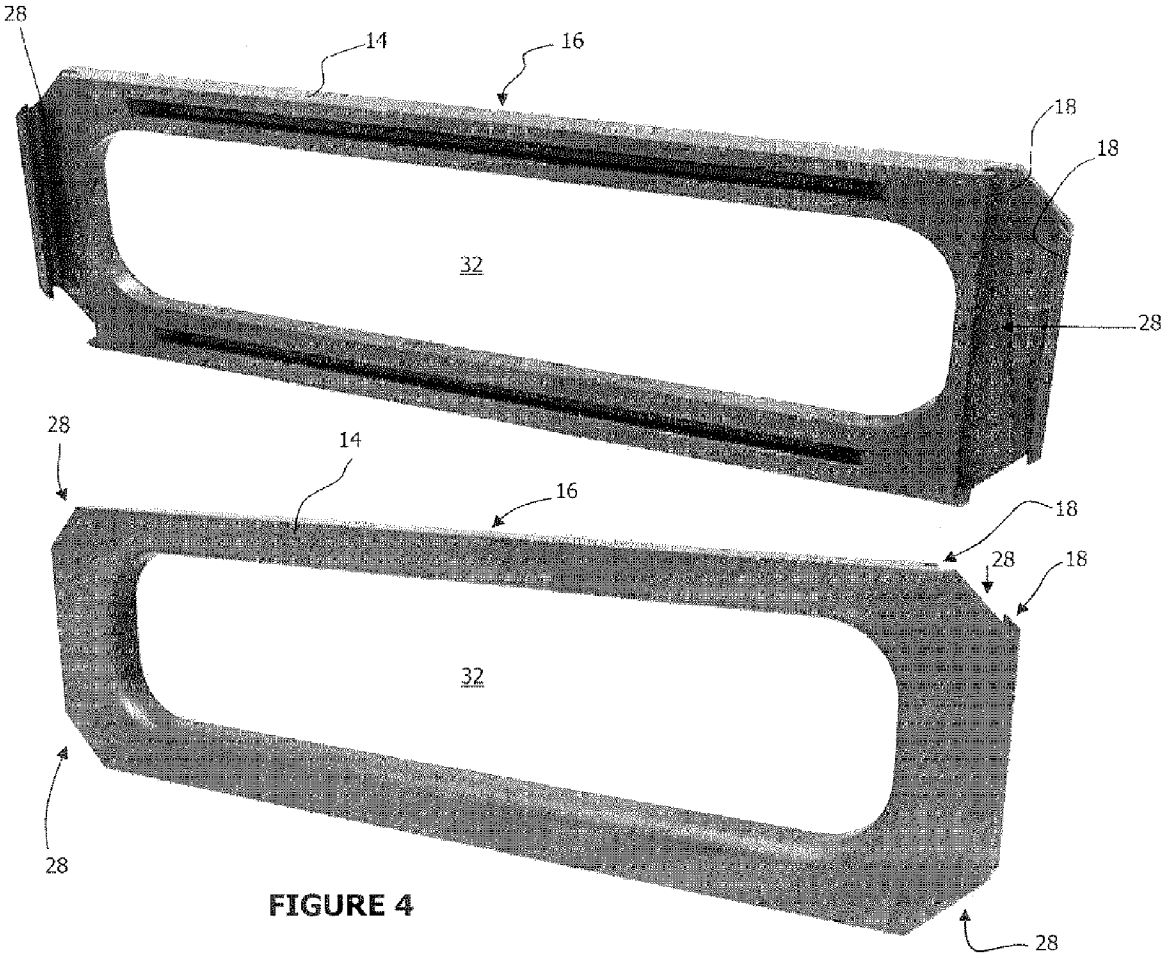
FIG. 4 shows front and rear perspective views of a side edge protective element of the pallet.

The body 12 may be recessed at locations where the protective elements 14 are coupled to allow for the thickness of the protective elements 14 and to thereby minimise protrusion of the elements 14 beyond the extremities of the body 12. In this way, the protective elements 14 may fit flush with the body 12, as shown in FIGS. 2 and 3.

EXAMPLE

In accordance with one particular example of the invention, the pallet may have embedded RFID tags in each corner post, and each corner post may be free standing to provide easy attachment of stretch wrap. A recess may be provided in each of the corner bumpers so as to provide secure pallet stacking. In this way, a protrusion at the upper portion of the corner bumper may fit within a recess in the corresponding corner bumper of the pallet stacked above.

The pallet may have an anti-slip feature on the side impact bumpers to increase load stability. The side impact bumpers serve to protect all areas of the pallet that come into contact with forklifts and pallet jacks. The edges of the side impact bumpers may be rounded for easy entry of pallet jacks.

The pallet may be bar coded on all four sides so as to facilitate easy identification of the particular pallet. Moreover, a logo may be provided at one or more corners of the pallet for easy identification.

The top deck of the pallet is in composite providing high impact resistance and stiffness similar to timber, with hand holes to facilitate easy handling. An underside of the top deck may have anti-slip grommets, and the pallet may have a cruciform bottom deck to provide increased coverage for bulk stacking and stability.

Main Features

Consistent: The pallet has a consistent 1,165×1,165 mm overall dimension that meets the Australian standard.

Light Weight: Weighing 24 kg each, the pallets are 20 kg lighter than existing hardwood pallets.

Durable and Strong: The pallets are manufactured from high impact compression moulded composite, maintaining standard dimensions throughout their lifetime. Replaceable impact bumpers make the pallets a new benchmark for minimum maintenance and extended lifespan.

RFID: With embedded RFID tags in each corner post, the pallets allow for easy tracking and identification.

Recyclable: The pallets, consisting of the core pallet and the outer protective impact bumpers, are all made from recycled material and at the end of life all pallets are 100% recyclable and will become part of new pallets.

Safe: No protruding nails or broken boards to injure employees or damage equipment or products.

Hygienic: The pallets are manufactured from food grade material which is impervious to infestation and does not absorb liquids.

Pallet Specifications

Dimensions: 1,165×1,165×140 mm

Weight: 24 kg

Static Load: 6,000 kg evenly distributed

Dynamic Load: 2,000 kg evenly distributed

Edge-Rackable Load: 1,500 kg

Top Deck: High impact compression moulded composite with a total thickness of 28 mm—96% coverage Bottom Deck: High impact compression moulded composite thickness of 22 mm with 50% coverage Impact Bumpers: High impact structural foam Forklift Openings: 805×90 mm RFID: Four identical passive tags, one in each corner Bar Code: One on each side of the pallet Temperature Range: −20° C. to 60° C.

Burn Index: Fire performance to exceed wooden pallets

FIGS. 6 to 12 show a pallet 10 in accordance with another example of the present invention. The pallet 10 shown in FIGS. 6 to 12 incorporates features similar the pallet shown in FIGS. 1 to 5, and like features are labelled with like reference numerals. The main differences between the pallet 10 of FIGS. 6 to 12 and the pallet 10 shown in FIGS. 1 to 5 include that (i) the protective elements 14 of the pallet 10 shown in FIGS. 6 to 12 are in the form of a bar or strip which is removably coupled to the upper portion 24 of the pallet 10 above each opening 30 along the four sides of the pallet 10. The protective elements 14 are in the form of side impact bumpers 16 which have a rounded profile to deflect the tine tips of a forklift into the openings 30. Another difference resides in that (ii) the pallet 10 shown in FIGS. 6 to 12 does not include a separate protective element 14 at each corner of the pallet 10, as does the pallet 10 shown in FIGS. 1 to 5.

As the protective elements 14 are in the form of straight elongated bars having a C-shaped cross-section, the protective elements 14 are able to be clipped onto a receiving edge 34 formed in the upper portion 24 which has upper and lower receiving cavities for engaging upper and lower lips of the protective elements 14. The receiving edges 34 may be provided with vertical ribs which are received inside the protective elements 14, serving to provide lateral support to the protective elements 14, whilst also allowing a degree of inward flexibility of the protective elements 14 to absorb impact from forklift tines or other bumps.

Figure 10:
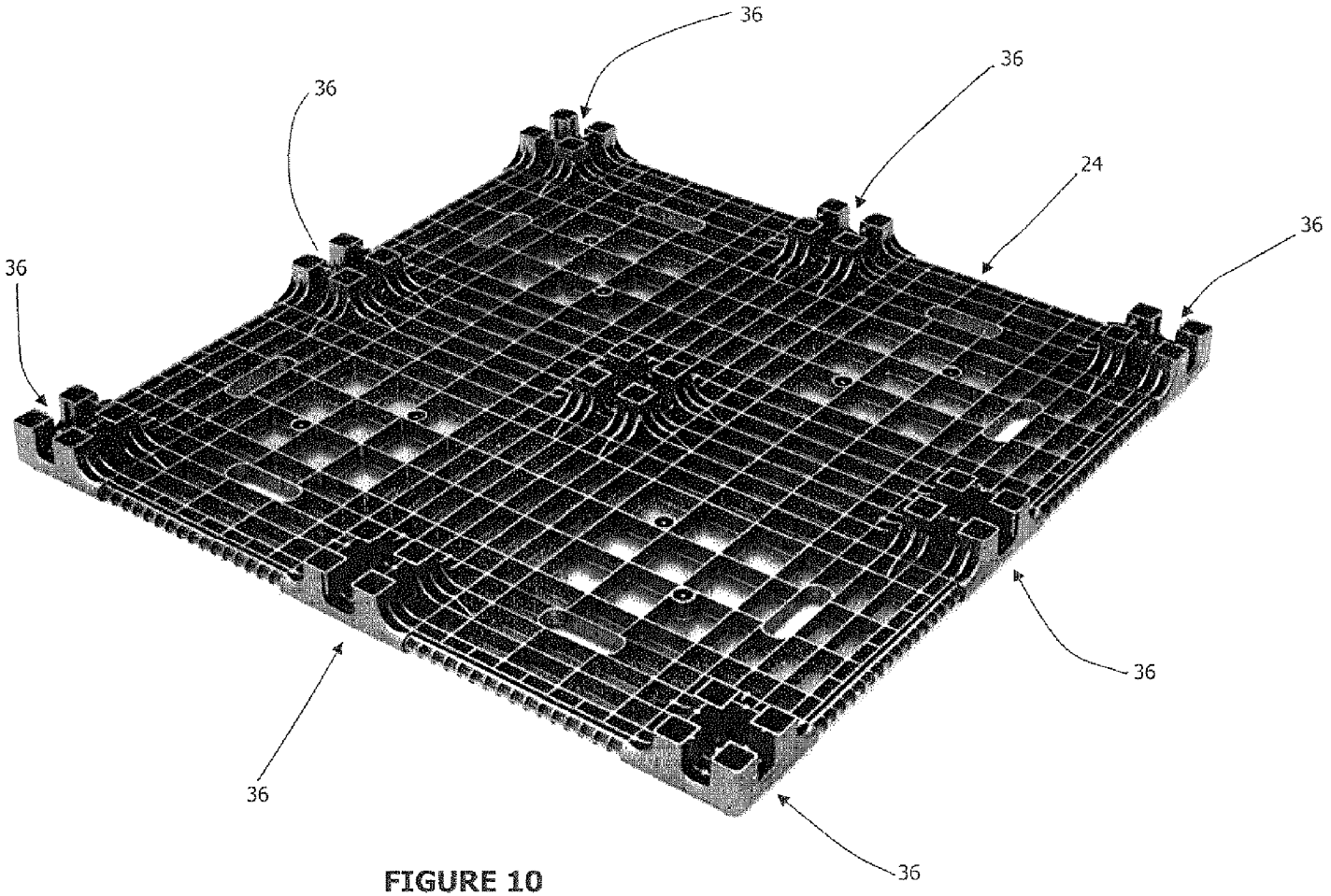
FIG. 10 is a bottom perspective view of the upper portion of the pallet.

As shown in FIG. 10, the underside of the upper portion 24 may be provided with a series of perpendicular ribs extending across the length and width of the upper portion 24 so as to provide strength to the pallet 10, and to resist collapse or deformation of the upper portion 24 when a load is placed on the pallet 10. The upper portion 24 may be provided with support receptacles 36 at each corner of the upper portion 24, as well as at intermediate locations midway between corners, along the four edges of the upper portion 24. A further support receptacle 36 may be provided at a central location of the upper portion 24. Each support receptacle may include four separate individual receptacles grouped together in a square formation.

Figure 11:
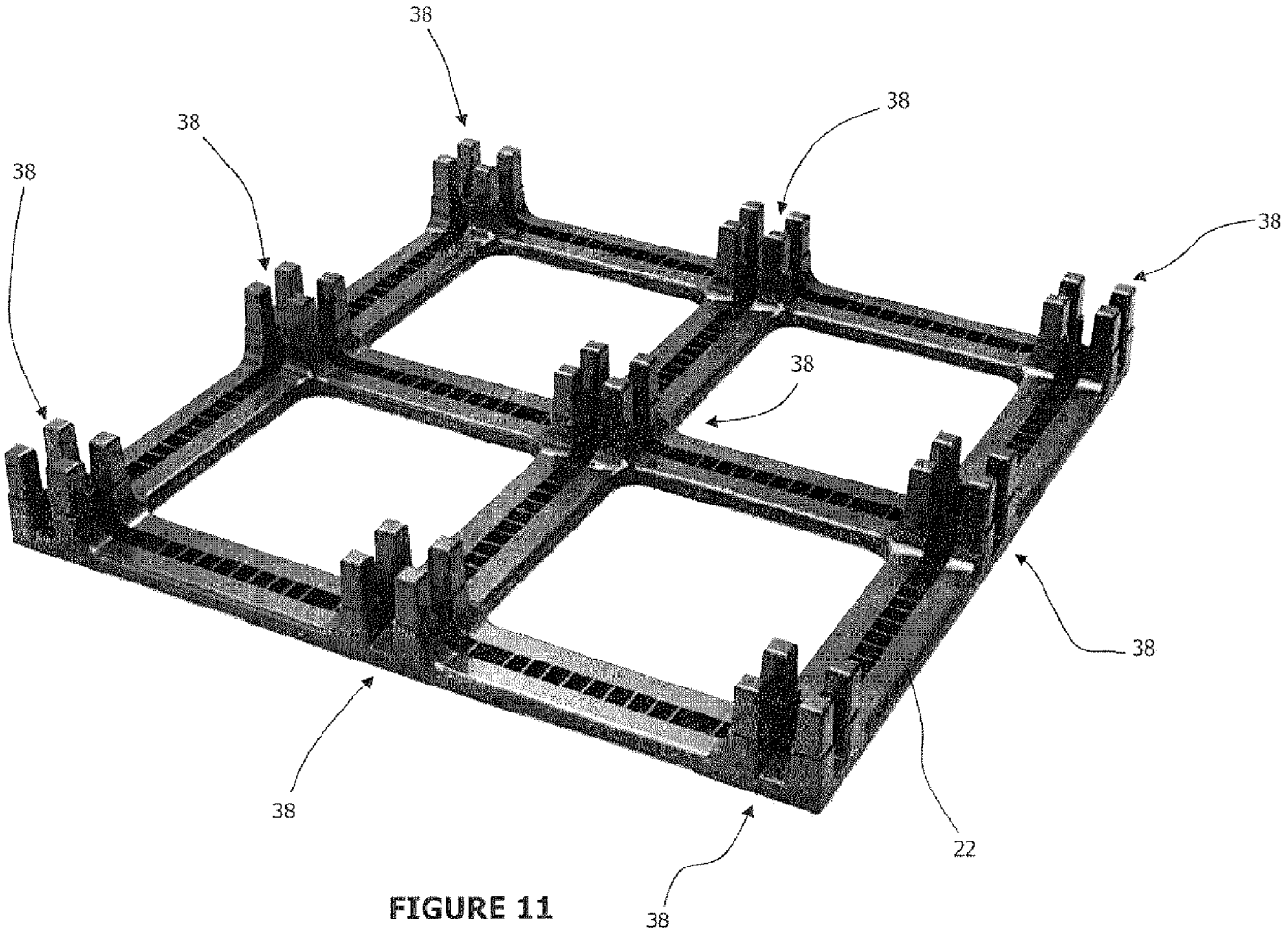
FIG. 11 is a top perspective view of a lower portion of the pallet.
Figure 12:
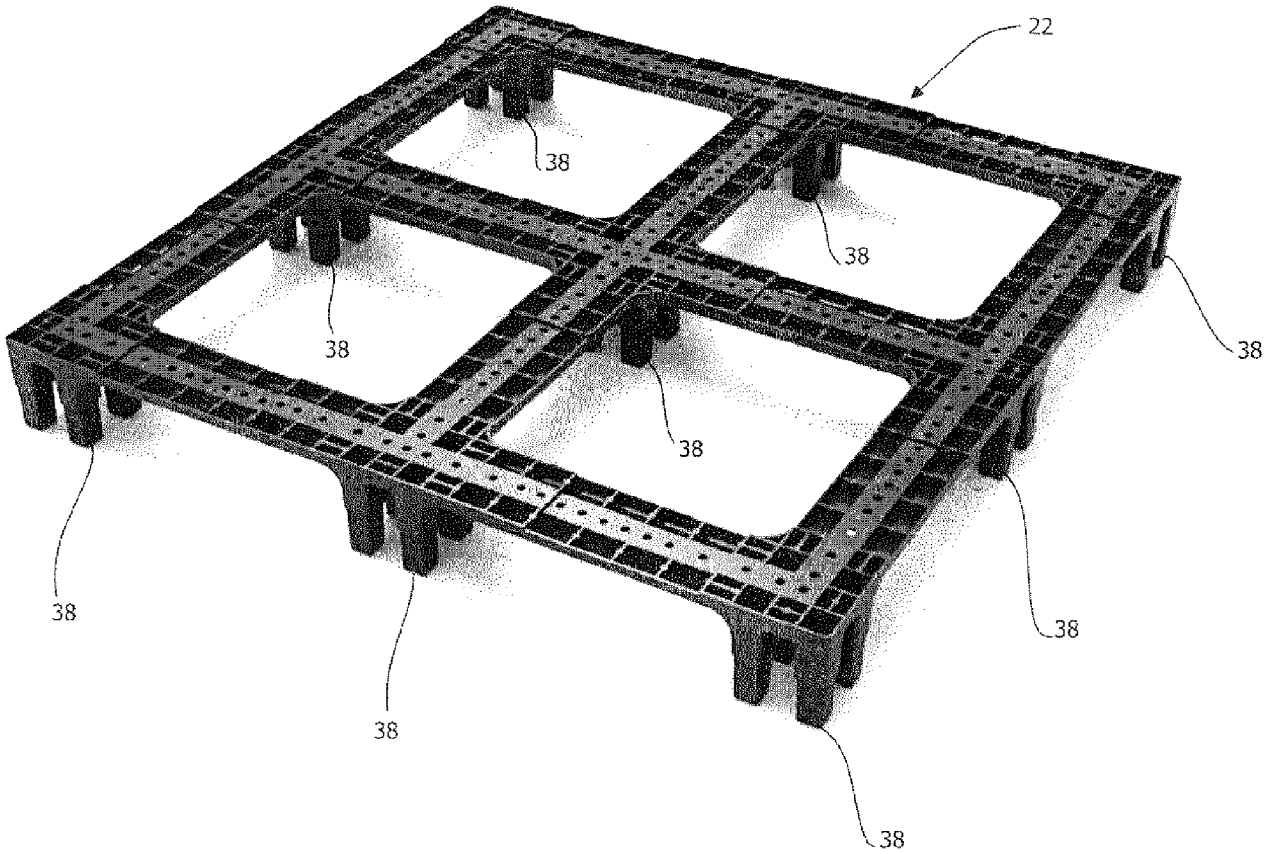
FIG. 12 is a bottom perspective view of the lower portion of the pallet.

With reference to FIG. 11, the lower portion 22 may have the general form of mutually perpendicular strips of material to save weight. More specifically, the lower portion 22 may be formed of three longitudinal strips and three lateral strips, with support legs extending upwardly at each intersection of the strips so as to be received in the support receptacles 36 of the upper portion 24. Each intersection of the longitudinal and lateral strips may be provided with four support legs 38 arranged in a square formation. While the general configuration of the lower portion 22 may be described as having longitudinal and lateral strips, it will be appreciated that the actual lower portion 22 shown in FIGS. 11 and 12 is moulded as a single piece. As shown in the top perspective view of FIG. 11, the external strips may have channels with ribs which extend perpendicular to the respective edge of the pallet 10 such that wheels of a pallet jack may ride over the ribs as the pallet jack is inserted into the openings 30. With reference to FIG. 12, the underside of the portion 22 may be provided with ribs to provide strength to the pallet 10 while reducing the weight of the pallet 10.

The protective elements 14 may be provided with a logo and/or with corporate colours such that the pallets 10 can be readily adapted to have identifiers relating to a particular user/owner. The components of the pallet may be formed from various materials, including cross-linked HDP or metal, long fibre thermoplastic, PET and/or polypropylene. The material may be formed with unidirectional fibre glass, or randomly oriented glass fibres. The applicant has determined that there may be advantages in reinforcing the material with long fibres, and by using compression moulding which does not break the strands, for example pressing with a weight of 2,500 tonnes.

For manufacturing reasons, the pallet 10 may be formed with two separately moulded parts of the lower portion 22 and the upper portion 24, which are then welded together. The welding may then be achieved by forming a plastic pin on one of the portions 22, 24 which forms a rivet extending through the other portion 24, 22. By virtue of the structure and the material, the pallet ma be significantly lighter than a hardwood pallet. For example, a typical hardwood pallet may weigh in the order of 45 kg, whereas a plastic pallet formed in accordance with the present invention may weigh in the order of 20 kg. Furthermore, owing to the structure and material of the present pallet 10, the pallet 10 provides a lightweight alternative which is able to meet the relevant standards by having little or no deflection when loaded with a specified load over a specified time.

FIGS. 13 to 16 show detail of the previous figures and, in particular, detail of the manner in which the protective elements 14 are able to be clipped onto the receiving edge 34 formed in the upper portion 24 which has upper and lower receiving cavities for engaging upper and lower lips of the protective elements 14. Advantageously, the upper and lower receiving cavities enable the protective elements to fit substantially flush with a surrounding surface of the pallet to minimise protrusion of the elements beyond the existing extremities of the body. In this way, an attractive finish is provided wherein the protective elements do not interfere with the visual lines of the pallet, and the protective elements are nested within the external extremities of the body such that the protective elements are securely attached to the protruding edges which may inadvertently get caught during use and unwantedly pry off the protective elements. Advantageously, the applicant has identified that this approach to the structural form of the pallet and the protective elements is possible by virtue of the innovative removal technique whereby the protective elements may be removed by performing a "surgical" trimming of the protective elements whereby each protective element is slit along its length to release tension within the cross-sectional shape of the protective element such that the slit part can then be easily removed. This removal technique is innovative and counter-intuitive, as is the structural configuration of the protective elements being flush with the surrounding part of the pallet as, without the inventive concept of the applicant's identification that protective elements could be removed in this way, the ordinary need to have part of the protective element to grip to pry off the pallet would have taught away from such a concept. Accordingly, the impact bumper is elastically clipped onto the pallet such that it cannot be removed without cutting a controlled groove in the curvature of the bumper by which the tension in the bumper will be released and the part can be removed without damage to the core pallet.

Figure 13:
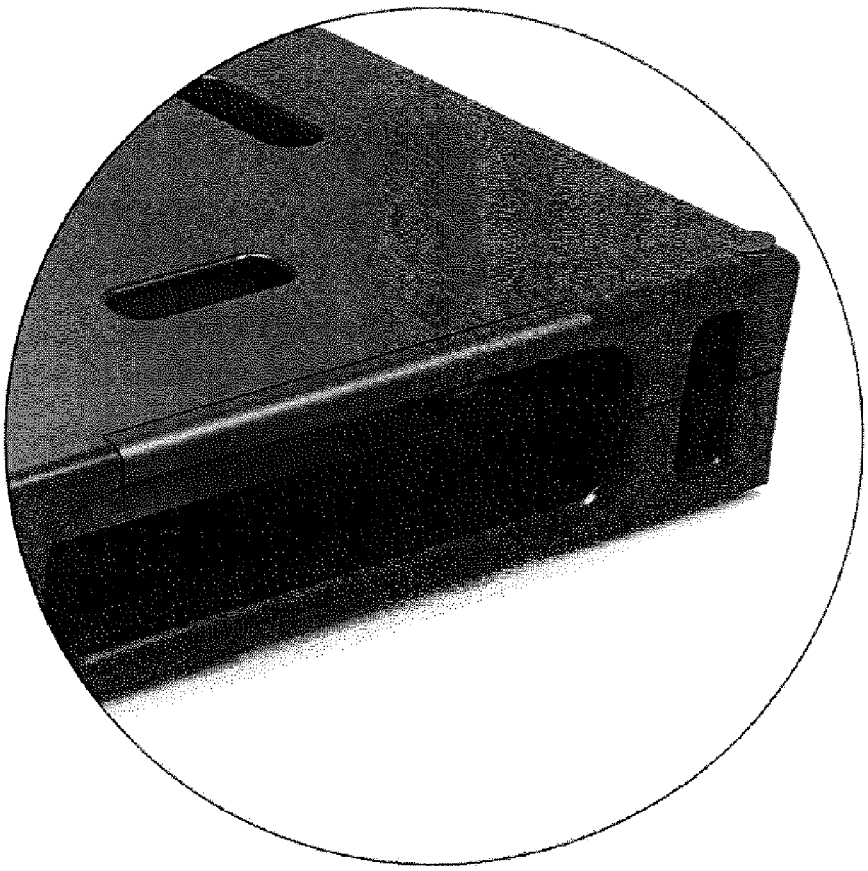
FIG. 13 is a detailed view of part of the assembly shown in FIG. 6.
Figure 14:
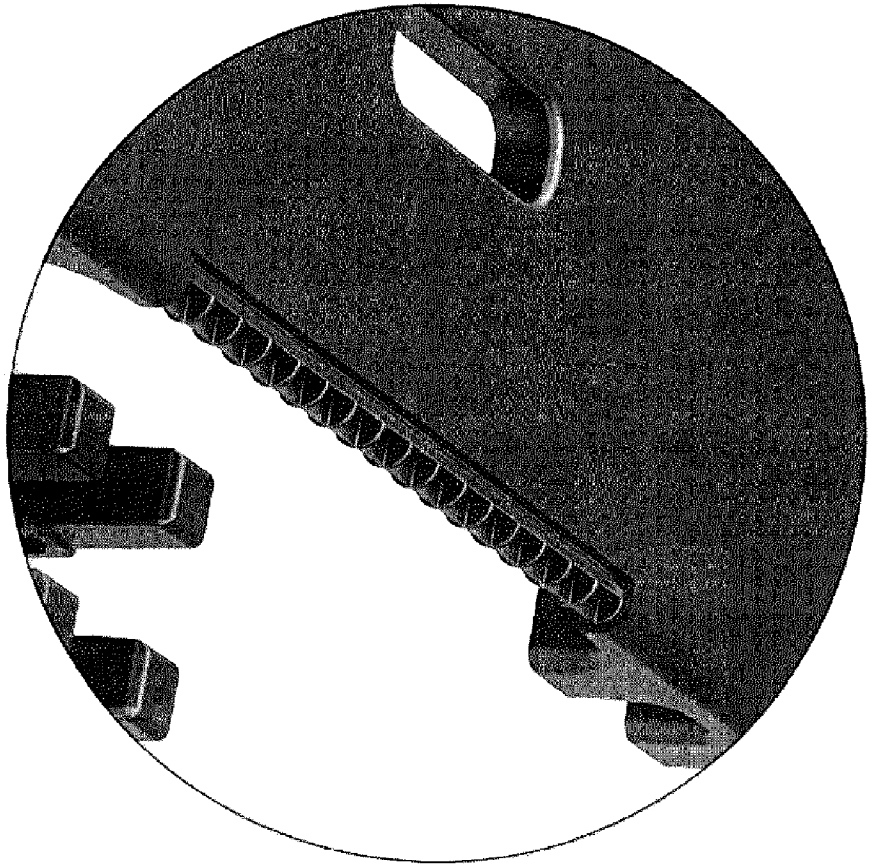
FIG. 14 is a detailed view of part of the pallet shown in FIG. 8.
Figure 15:
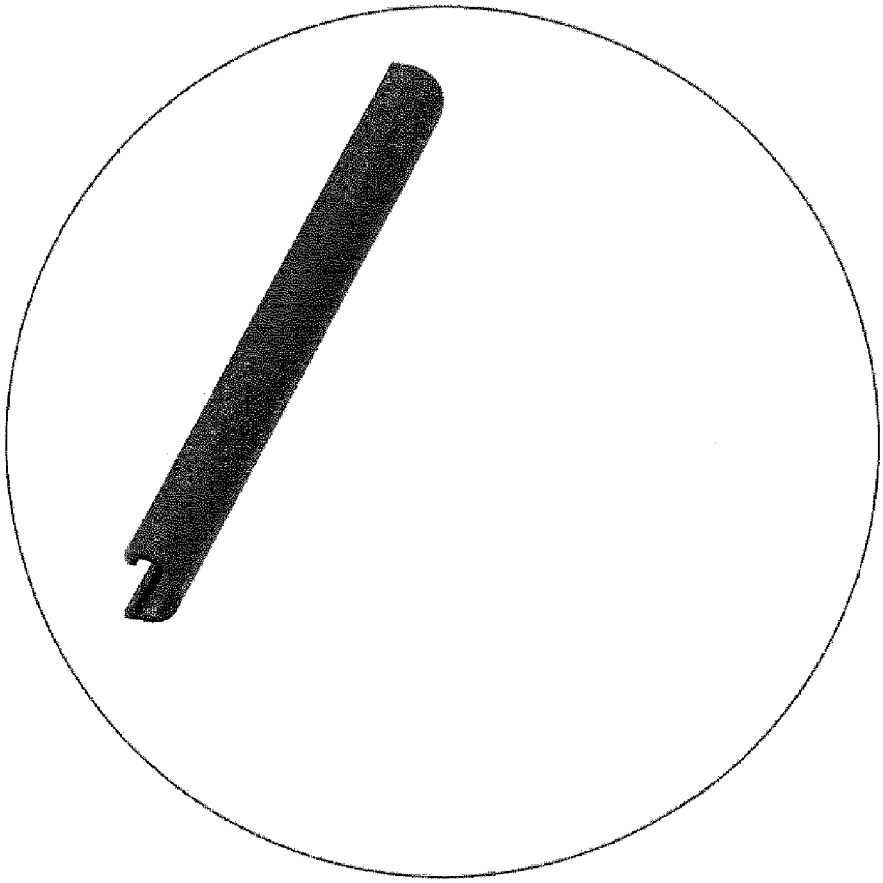
FIG. 15 is a detailed view of one the protective elements shown in FIG. 8.
Figure 16:
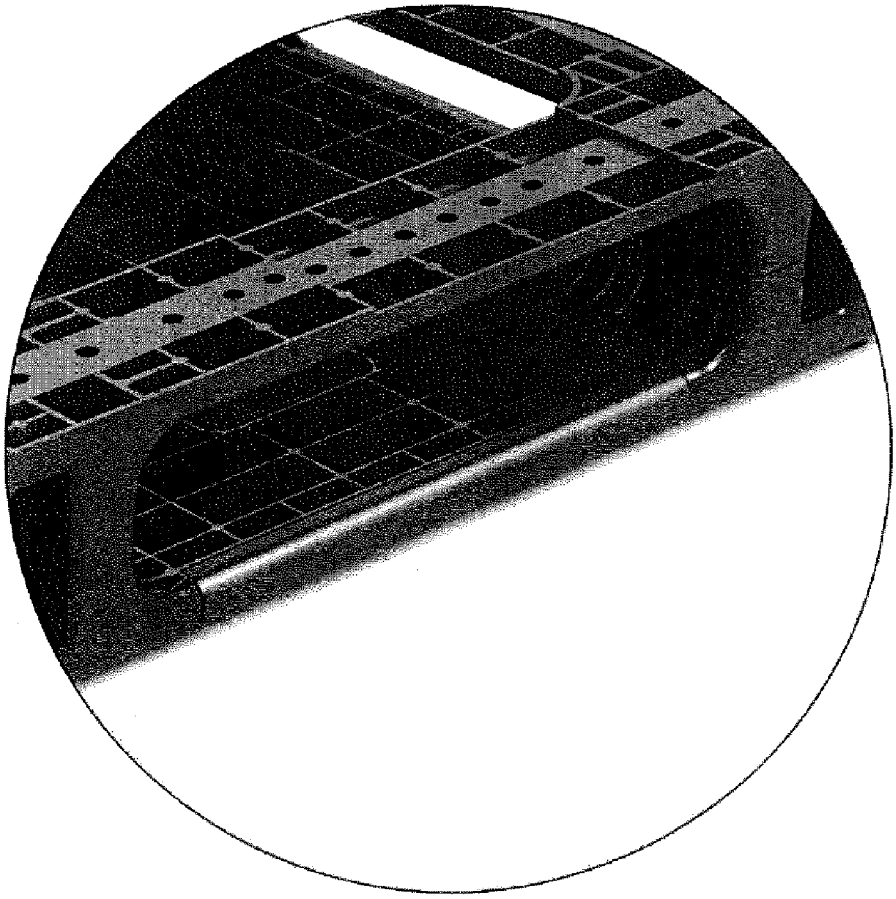
FIG. 16 is a detailed view of the pallet shown in FIG. 7.
Figure 17:
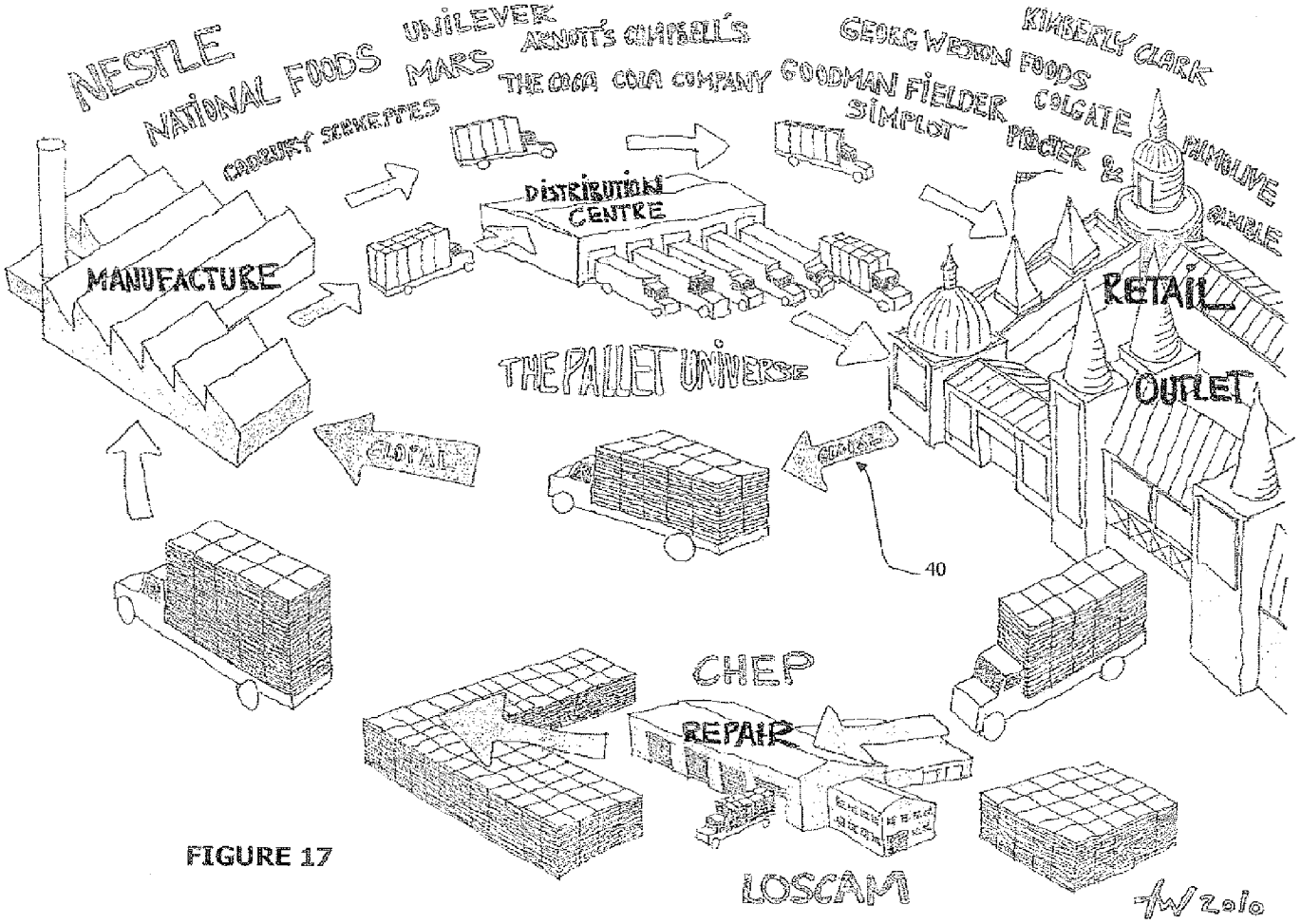
FIG. 17 is a diagrammatic representation illustrating an optimised life cycle of a pallet in accordance with the present invention.

Turning to FIG. 13, examples of the a present invention provide a more efficient lifecycle for a pallet, particularly pallets used in the so-called Fast Moving Consumer Goods (FMCG) market. The existing typical pallet lifecycle is represented in FIG. 13 by the outer path which includes a "Repair" step at the bottom of the drawing, and the optimised lifecycle utilises a shorter path 40 across the middle of the drawing which bypasses the Repair step. Advantageously, where existing pallets need to be repaired when they are damaged, the pallets 10 according to examples of the present invention may simply have the protective elements 14 replaced so as to render the pallet useful once again. With this in mind, the protective elements 14 are located on the pallet 10 at locations which are most prone to damage, such as above the openings 30 as shown in FIGS. 6 to 12. These locations are particularly prone to damage from the tips of tines of forklifts, as well as by the forklift abutting against the pallet 10 at these locations during insertion, lifting and transportation.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. A pallet for transporting and/or storing goods, the pallet comprising:

a body and a plurality of protective elements removably coupled to the body to prevent damage to the body, the protective elements being fitted and coupled to the body by a releasable coupling to facilitate removal of the protective elements and replacement of damaged protective elements with fresh protective elements, the body having openings for receiving a fork of a lifting device to allow lifting of the pallet by the lifting device, the protective elements being arranged on the body to abut the lifting device during insertion of the fork in the openings and/or lifting of the pallet by the lifting device, a separate one of the protective elements being located with each separate opening, said releasable coupling being provided by resilience in each protective element in combination with the protective element being in the form of an elongated member having a cross-section adapted to enable the protective element to be resiliently clipped onto the body by pushing the element onto the body, said resilience allowing elastic deformation of the element during pushing of the element onto the body whereby the element interlocks with the body, and the body being recessed at locations where the protective elements are coupled thereby accommodating the thickness of the protective elements such that the protective elements fit substantially flush with a surrounding surface of the pallet to thereby minimize protrusion of the elements beyond existing extremities of the body such that removal of each protective element from the body requires slitting the protective element along its length to thereby release tension in the protective element and thus release compressive attachment forces with respect to the pallet body.

2. A pallet as claimed in claim 1, wherein each protective element is in the form of an elongated member having a constant cross-section along the length of the elongated member.

3. A pallet as claimed in claim 2, wherein each protective element has a C-shaped cross-section.

4. A pallet as claimed in claim 2, wherein each protective element is in the form of a straight bar.

5. A pallet as claimed in claim 1, wherein each protective element has a rounded profile to deflect tine tips of the fork of the lifting device into the respective opening.

6. A pallet as claimed in claim 1, whereby the releasable coupling in the form of resilience in each protective element allows the element to be installed on the body in a fully automated repair setup by pushing the element laterally onto the body.

7. A pallet as claimed in claim 1, wherein the protective elements are arranged on the body to abut the lifting device when the fork is fully inserted in the openings.

8. A pallet as claimed in claim 1, wherein each of the protective elements is located above the respective opening.

9. A pallet as claimed in claim 1, wherein the resilience in the protective elements is overcome in both coupling and decoupling the protective elements to/from the body.

10. A pallet as claimed in claim 9, wherein the releasable coupling is provided by the protective elements being resiliently deformable, and the protective elements are deformed in both coupling and decoupling the protective elements to/from the body.

11. A pallet as claimed in claim 1, wherein the pallet has two openings along each edge to allow insertion of the fork into any edge of the pallet.

12. A pallet as claimed in claim 1, wherein the pallet is generally rectangular.

13. A pallet as claimed in claim 1, wherein the body is made of high impact composite.

14. A pallet as claimed in claim 13, wherein the body is made of reinforced thermoplastic, and the protective elements are made of metal or high impact thermoplastic.

15. A pallet as claimed in claim 13, wherein the body and the protective elements are made of the same thermoplastic, e.g. PET, PP, HDPE or similar.

16. A pallet as claimed in claim 1, wherein each of the protective elements has interlocking formations which interlock with corresponding interlocking formations of the body.

17. A pallet as claimed in claim 1, wherein the body is in the form of an assembly including a lower portion and an upper portion.

18. A pallet as claimed in claim 17, wherein the lower portion and upper portion are assembled once and remain assembled until recycling at the end of the life of the pallet.

19. A pallet as claimed in claim 1 wherein the protective elements are engaged to the body by hydraulic force whereby said protective elements are pressed in the horizontal plane of the pallet onto the body.

20. A pallet for transporting and/or storing goods, the pallet comprising:

a body and a plurality of protective elements removably coupled to the body to prevent damage to the body, the protective elements being fitted and coupled to the body by a releasable coupling to facilitate removal of the protective elements and replacement of damaged protective elements with fresh protective elements, the body having openings for receiving a fork of a lifting device to allow lifting of the pallet by the lifting device, the protective elements being arranged on the body to abut the lifting device during insertion of the fork in the openings and/or lifting of the pallet by the lifting device, a separate one of the protective elements being located with each separate opening, said releasable coupling being provided by resilience in each protective element in combination with the protective element being in the form of an elongated member having a cross-section adapted to enable the protective element to be resiliently clipped onto the body by pushing the element onto the body, said resilience allowing elastic deformation of the element during pushing of the element onto the body whereby the element interlocks with the body, and the body being recessed at locations where the protective elements are coupled thereby accommodating the thickness of the protective elements such that the protective elements fit substantially flush with a surrounding surface of the pallet to thereby minimize protrusion of the elements beyond existing extremities of the body.

21. A method of using a pallet as defined in claim 1, including:

fitting the pallet with resilient protective elements in the form of replaceable bumpers by pressing the protective elements onto the pallet in a resilient clip-fit;

using the pallet to transport and/or store goods;

automatically electronically scanning the condition of the bumpers to determine whether each of the bumpers is ready to be replaced; and for each of the bumpers deemed ready to be replaced, automatically removing the bumper by slitting the bumper along its length to release tension in the bumper thereby releasing compressive attachment forces and fitting a replacement bumper in its place onto the pallet by pressing the replacement bumper into a resilient clip-fit engagement with the pallet.

* * * * *